US012181228B2

(12) United States Patent
Martins Coelho et al.

(10) Patent No.: US 12,181,228 B2
(45) Date of Patent: Dec. 31, 2024

(54) DEVICE TO REPAIR LEAKAGE IN HIGH PRESSURE SHELL-AND-TUBES HEAT EXCHANGER USING GASKET AND TENSIONING BY CASES

(71) Applicant: PETRÓLEO BRASILEIRO S.A.—PETROBRAS, Rio de Janeiro (BR)

(72) Inventors: Elbert Fernando Martins Coelho, Betim (BR); Wagner Henrique Saldanha, Betim (BR)

(73) Assignee: PETRÓLEO BRASILEIRO S.A.—PETROBRAS, Rio de Janeiro (BR)

( * ) Notice: Subject to any disclaimer, the term of this patent is extended or adjusted under 35 U.S.C. 154(b) by 69 days.

(21) Appl. No.: 18/327,354

(22) Filed: Jun. 1, 2023

(65) Prior Publication Data

US 2023/0392883 A1 Dec. 7, 2023

(30) Foreign Application Priority Data

Jun. 2, 2022 (BR) ..... 10 2022 010827 7

(51) Int. Cl.
*F28F 11/00* (2006.01)

(52) U.S. Cl.
CPC ..... *F28F 11/00* (2013.01); *F28F 2230/00* (2013.01)

(58) Field of Classification Search
CPC ..... F28F 11/00; F28F 2230/00; F22B 37/003
USPC ..... 165/76
See application file for complete search history.

(56) References Cited

U.S. PATENT DOCUMENTS 1,884,080 A * 10/1932 Miller ..... F28F 9/0219 165/72
3,231,012 A * 1/1966 Norris ..... F28F 9/00 165/81
3,721,291 A * 3/1973 Massaro, Jr. ..... F28F 9/0219 165/158
4,652,023 A 3/1987 Timmons
5,323,849 A * 6/1994 Korczynski, Jr. ..... F28F 11/00 165/905
5,950,683 A 9/1999 Henderson
6,796,453 B2 * 9/2004 Sanders ..... B29C 65/78 220/581
9,097,466 B2 * 8/2015 Braic ..... F02B 29/0462
(Continued)

FOREIGN PATENT DOCUMENTS

BR 8504145 6/1986
CN 103062571 4/2013
(Continued)

*Primary Examiner* — Jon T. Schermerhorn, Jr.
(74) *Attorney, Agent, or Firm* — Knobbe Martens Olson & Bear, LLP

(57) ABSTRACT

The present invention refers to a device to repair leakage in high pressure shell-and-tube heat exchanger using gasket and tensioning by cases. The device aims to repair leakages in heat exchangers in flanged connections of large diameter where there is the gap or channel to allow for gasket placement. The device is fully screwed, with no risk of flash during its implantation and can be used at high temperatures and pressure, in addition to presenting an ease of manufacture/assembly, reducing implementation costs. Basically, the device comprises an adjustment screw holder, gasket compression ring, stabilizer support, and compression adjustment screws.

17 Claims, 5 Drawing Sheets

(56) References Cited

U.S. PATENT DOCUMENTS

| | | | | |
|---|---|---|---|---|
| 9,678,043 | B2 * | 6/2017 | Ostergren | G01N 29/28 |
| 10,928,137 | B2 * | 2/2021 | Sakakura | F16J 13/12 |
| 2003/0010479 | A1 * | 1/2003 | Hayashi | F02M 26/32 165/157 |
| 2005/0034847 | A1 * | 2/2005 | Graham | F28F 9/02 165/158 |
| 2009/0223053 | A1 * | 9/2009 | Gandy | B23K 9/0286 29/890.031 |
| 2010/0294460 | A1 * | 11/2010 | Duchet-Annez | F28D 1/0417 165/76 |
| 2014/0000842 | A1 * | 1/2014 | Gruneisen | F28D 9/0031 165/76 |
| 2016/0159122 | A1 * | 6/2016 | Nishio | B41J 29/377 347/101 |
| 2023/0417356 | A1 | 12/2023 | Dalpiaz et al. | |

FOREIGN PATENT DOCUMENTS

| | | |
|---|---|---|
| DE | 19519341 | 6/1996 |
| DK | 173450 | 11/2000 |
| KR | 200176568 | 4/2000 |
| WO | WO 13/040699 | 3/2013 |

* cited by examiner

DEVICE TO REPAIR LEAKAGE IN HIGH PRESSURE SHELL-AND-TUBES HEAT EXCHANGER USING GASKET AND TENSIONING BY CASES

FIELD OF THE INVENTION

The present invention is addressed to the technical field of oil and gas, more specifically to the maintenance and facilities for the supply, hydrorefining and treatment of fuels, and refers, more specifically, to a device to repair leakages in shell-and-tube heat exchangers of high pressure using gasket and tensioning by cases or casings.

BACKGROUND OF THE INVENTION

With the purpose of providing a better understanding of the present invention, a brief explanation of the state of the art will be presented, as well as the existing problems, where it will be possible for a person skilled in the art to recognize the already existing limiting aspects, in order to understand at a later time the technical characteristics of the proposed solution to solve the problem.

Currently, it is noticed that many times when referring to treatments and hydrorefining of fuels in the oil and gas industry, there may be occurrences of fluid leakages (naphtha, water, etc.) in the flanged connection between the mirror and the shell (flange) during operation in the high pressure heat exchanger, with SMS risks (Segurança, Meio ambiente e Saúde—Safety, environment and health).

Conventionally, in order to solve this technical problem, a "welded cape" (enclosure) consisting of applying a plate designed according to a cylindrical shell and welded in the region between the flanges. However, this solution is considered unfeasible because there could be a risk of fire and explosion when welding a product with hydrocarbon and hydrogen ($H_2$).

Other disadvantages related to this solution are the large thickness of the plate for the design (with no plate available in the stock), the possibility of deformations in the equipment due to the large amount of welding, and at a next stop being necessary to buy another equipment, as it would be out of the design condition, thus, it would not be possible to simply inspect it and change the gasket.

Another commercially available technical solution is what might be called "clamp" (armlet, brace). This solution consists of a machined plate, generally designed according to ASME PCC2 (technical standard), where the sealing element would be an injectable sealant. The disadvantages of this solution are related to the great thickness of the plate, as it is necessary to perform the calculation considering the outer radius of the flanges, so the greater the thickness, the more expensive the service.

In addition to the complexity of the design, because the heat exchanger is at high pressure, a sealant with a compatible pressure must be injected, requiring a large amount of sealant injection to fill the empty space between the mirror and the clamp, not being guaranteed that the device will repair the leakage, since it depends on the performance of the sealant, which often hardens before filling the entire leakage space.

Also, it is considered a high cost solution, with a time required to carry out the agreement, which could be long, due to the contract and bidding process and the amounts available for the budget, so the leakage would continue to increase, and it would no longer be possible to access the place, due to the risks.

It is also helpful to describe that in order to solve this technical problem, methods are commonly used as described below, wherein the protocols are carried out in the following sequence: 1) checking torque in operation; 2) recalculating the flanged connection to define the torque above the standard torque and applying a new torque; 3) evaluating the possibility of capping (enclosure) and welding of the flanged connection, however this was discarded due to the high risk and the deformations that would be imposed.

A release assessment 4) was also carried out to replace the joint, however, it would be necessary to stop the unit with loss of production. Thus, none of the aforementioned protocols was confidential and effective in resolving the problem due to technical and logistical problems, as in the case of the last protocol, for example (evaluation method 4).

In view of the above, it is clear that there is a need to develop a device to repair fluid leakages in the liquid state in the flanged connection (between mirror and flange) of a shell-and-tube heat exchanger that operates at high temperatures and high pressures, which fluid may be hydrocarbons and hydrogen ($H_2$).

Additionally, there is a need for this device to be used during the hydrocarbon processing operation in the oil industry, without the need to stop the production so that it can be assembled and installed.

STATE OF THE ART

In the state of the art, there are devices designed for sealing pipes using engaged mechanical parts in which it is possible to establish a pressure on a gasket present in a flanged connection. However, the state of the art devices have shortcomings related to installation during production, specific application in heat exchangers and use of solder, which is not used in the present invention, due to the possibility of explosions.

Patent document BR112014006602-7 discloses an apparatus for sealing an open end of a tube which includes a seal means for forming a circumferential seal between the apparatus and the inner surface of the tube and a first and second "grip" means for the frictional engagement of the inner and outer surfaces of the tube, respectively, to prevent relative axial movement between the apparatus and the tube. However, there is no mention that said solution can be applied in heat exchangers, which requires different technical requirements for this type of device.

In turn, document CN103062571 describes a leakage stop device for pipe holes leakage points. The device comprises a fixture bracket assembly and a leakage holding body assembly. Said document, in principle, is also based on the provision of specific means that allow establish a specific compressive force on the gasket in order to prevent liquid leakage from pipes carrying fuels such as oil and gas. However, it presents a temporary solution to the aforementioned technical problem, as it mentions the possibility of performing a subsequent welding, and focusing on a specific leakage point. On the other hand, the present invention provides a device for solving the problem without the need for welding and other interventions along the entire circumference of a pipe flanged connection.

Document DK173450, on the other hand, defines a gasket assembly for external sealing of the tube plate of a tubular element, which is fixed between the heat exchanger counterflanges (collection flanges). The gasket assembly consists of a gasket seat ring with seal joint that is mounted on a given heat exchanger at the installation point. However, it differs from the present invention, mainly due to the fact that there is a milling/excavation of a keyway groove in the existing flange, and in the present invention there is no need for machining operations on the flange, so the present invention ends up have a technological advantage of allowing the repair in operation with high pressures and temperatures. Furthermore, in the present invention the gasket is pressed against the mirror of the heat exchanger, and not against the adjacent flange on the heat exchanger.

Document PI8504145 protects a flanged tube and jacket heat exchanger gasket sealing device comprising compressible gaskets and less compressible gasket retainers arranged circumferentially around the gaskets. However, said document does not make it clear whether the invention can be used during operation in industry, which is one of the main advantages of the present invention. Furthermore, in equipment operation, when this sealing system of the heat exchanger flanged connection fails, said device does not allow repairs with the equipment in operation. There is no way to disassemble the equipment without removing the flange connection cases. And it is not possible to remove the cases with the equipment in operation, as it has pressurized hydrocarbon and subjected to high temperature.

Finally, document KR200176568 refers to a spiral-wound gasket to prevent fluid leakage between the flanged connection, industrial pipe flanges, such as in various petrochemical plants, heat exchangers, etc. It can be seen that in said document only one sealing item is described, called a gasket or joint, which exclusive use does not solve the problem of a possible leakage, as occurs in the present invention.

BRIEF DESCRIPTION OF THE INVENTION

The present invention defines, according to a preferred embodiment, a device to repair leakages in high pressure shell-and-tube heat exchangers using gasket and tensioning by cases or casings.

The purpose of the device is to repair leakages in heat exchangers in flanged connections of large diameter where there is gap or channel to allow for gasket placement. The device is fully bolted, with no risk of flash during its implantation and can be used at high temperatures and pressure, in addition to presenting an ease of manufacture/assembly, reducing implementation costs. Basically, the device comprises an adjustment screw holder, gasket compression ring, stabilizer support, and gasket compression adjustment screws.

BRIEF DESCRIPTION OF THE FIGURES

In order to complement the present description and obtain a better understanding of the characteristics of the present invention, and in accordance with a preferential embodiment thereof, a set of figures is presented in annex, where in an exemplified way, although not limiting, it represents the preferred embodiment.

DETAILED DESCRIPTION OF THE INVENTION

The present invention relates to a device to repair leakages in heat exchangers in large diameter flanged connections where there is the gap or channel to allow the placement of the gasket, according to a preferred embodiment of the present invention, is described in detail, based on the attached figures.

Figure 1:
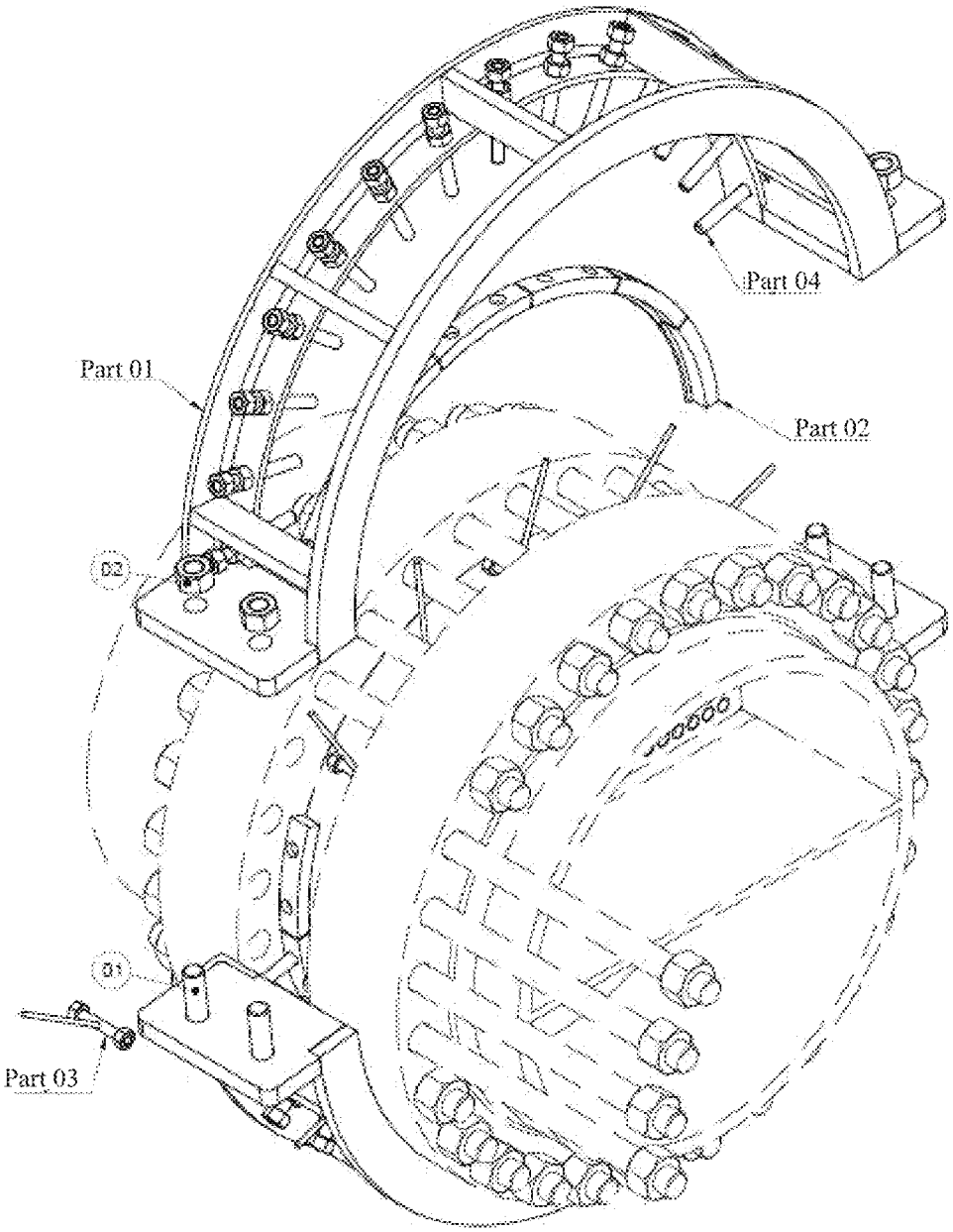
FIG. 1 shows an exploded view of the device, highlighting the fact that it comprises an adjustment screw holder 1, gasket compression ring 2, stabilizer support 3, and gasket compression adjustment screws 4, according to a preferred embodiment of the present invention.

FIG. 1 represents an exploded view of the device showing that it basically comprises at least one adjusting screw support 1, at least one gasket compression ring 2, at least one stabilizing support 3, and at least one gasket compression adjustment screw 4, according to a preferred embodiment of the present invention.

Figure 3:
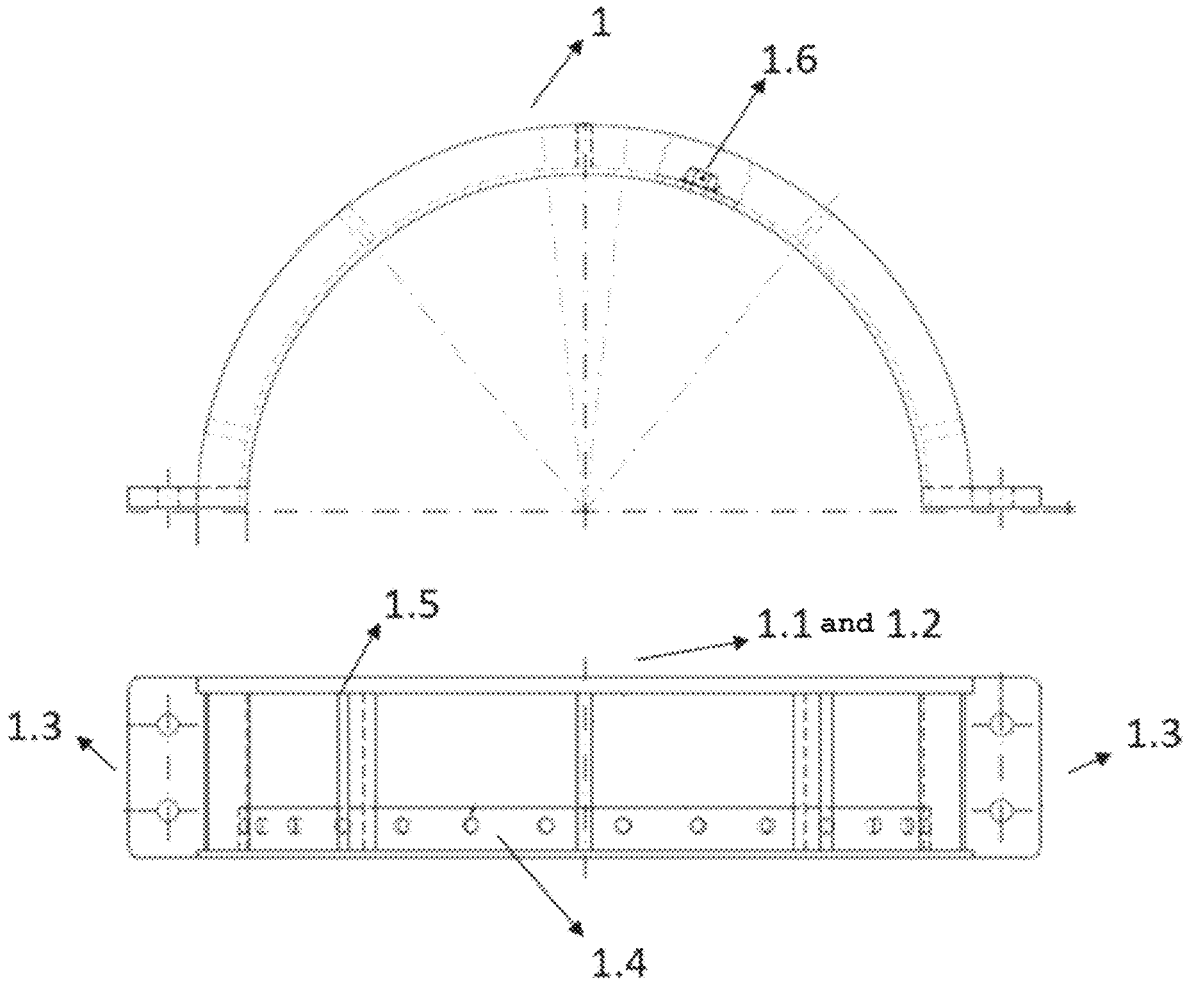
FIG. 3 shows the front view and the top view of part 01, referring to the adjustment screw holder 1, according to a preferred embodiment of the present invention.

FIG. 3 shows the adjustment screw holder 1 comprising a body with two symmetrical parts 1.1 and 1.2 in the shape of a semicircle with a radius of 860 mm made of a smooth plate of ASTM A283 Gr. C steel (or similar) and ¾ inch thick as shown in the top front view, each part comprising two joining members 1.3 230 mm long and 150 mm wide, at their respective ends (of greater thickness (1 inch), but of the same material).

Each connection element 1.3 is drilled with two hollow holes with approximately 28 mm diameter, as shown in the top view. An angle bracket 1.4 (circumferential element) specially adapted to receive the gasket compression adjustment screws 4 comprising at least 14 holes of ¾ inch diameter and preferably manufactured with A36 low carbon steel.

And also reinforcing bars 1.5 equally spaced in the longitudinal direction, for example, with a distance forming an arc of 39°. Said gasket compression adjustment screws 4 are fastened by hexagonal nuts 1.6 of ⅝ inches diameter being manufactured with material corresponding to A194 Gr. 2H steel and being soldered into all holes.

It can be said that the adjusting screw bracket 1 is the part that allows the positioning and fixation of the gasket compression adjustment screws 4, functioning as a stabilizing structure of the device of the present invention.

Figure 4:
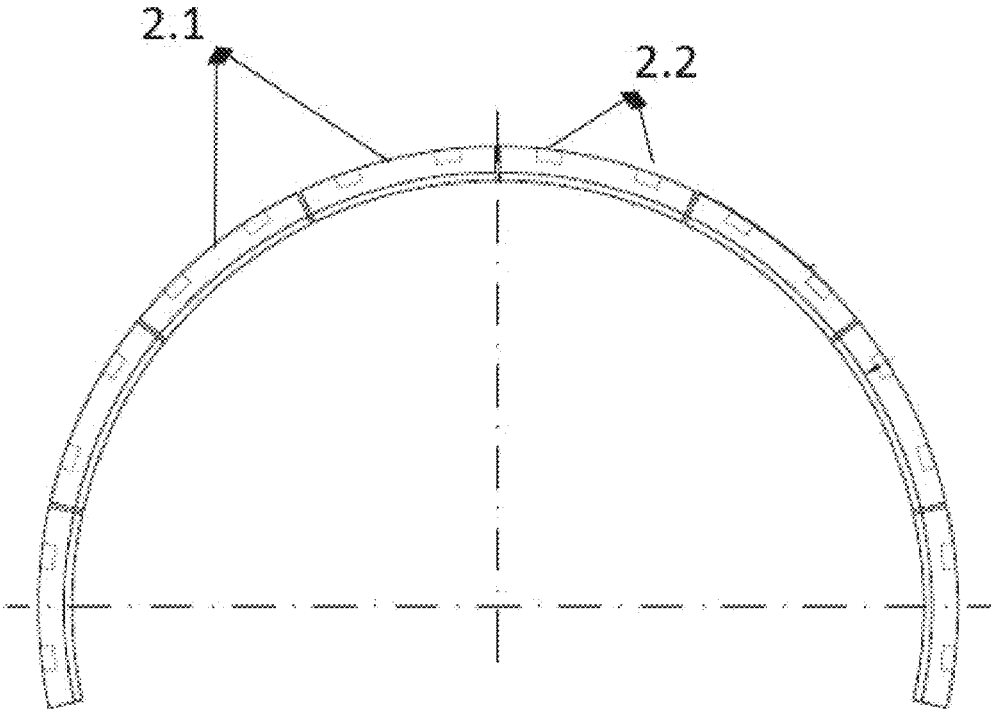
FIG. 4 shows the front view of part 02, referring to the compression ring of the gasket 2, according to a preferred embodiment of the present invention.

In FIG. 4, the gasket compression ring 2 is represented, which comprises at least 662 mm radius and which is preferably made of a set of smooth plates 2.1 with a plurality of blind holes 2.2, each blind hole especially adapted to receive the end of a gasket compression adjustment screw 4.

It can be said that the gasket compression ring 2 is the part that allows the tightening and compression of the gasket, which is the sealing element that stops the leakage when compressed between the faces containing the leakage.

Figure 5:
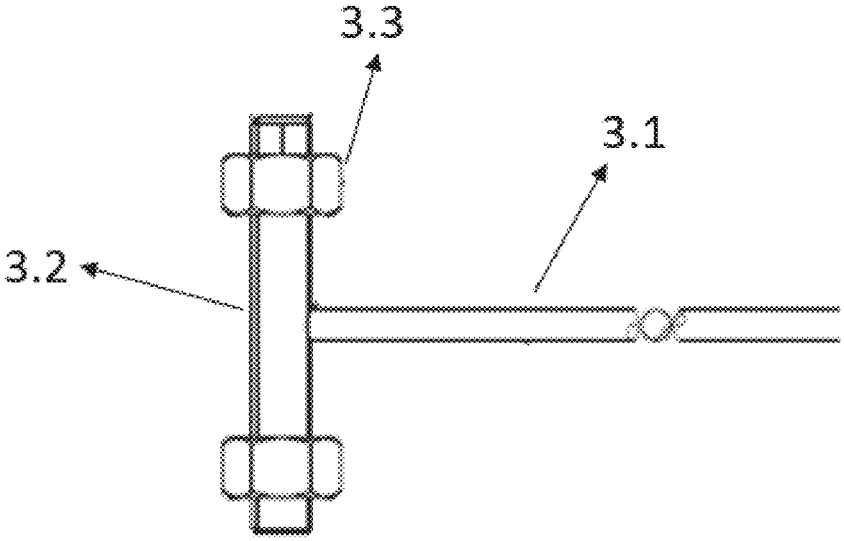
FIG. 5 shows the front view of part 03, referring to the stabilizer support 3 which has a "T" shape, according to a preferred embodiment of the present invention.

FIG. 5 shows the stabilizing support 3 which preferably has a "T" shape and comprises a cylindrical bar 3.1 of greater length with at least 150 mm and a diameter of ¼ inch made preferably of carbon steel, a threaded bar 3.2 of at least 85 mm length and at least ½ inch diameter made preferably of the material referred to as A193 Gr.B7 steel, and also hexagonal nuts 3.3 with ½ inch diameter and preferably made of A194 Gr. 2H.

It can be said that the stabilizing support 3 is a fundamental part for the device to fulfill its function, as it allows the stabilization of the gasket compression ring 2, thus the compression transmitted from the compression adjustment screws from the gasket 4 to the gasket compression ring 2 is improved.

Thus, a decomposition of the force components is avoided. Better gasket compression is what allows the leakage to be repaired.

Figure 6:
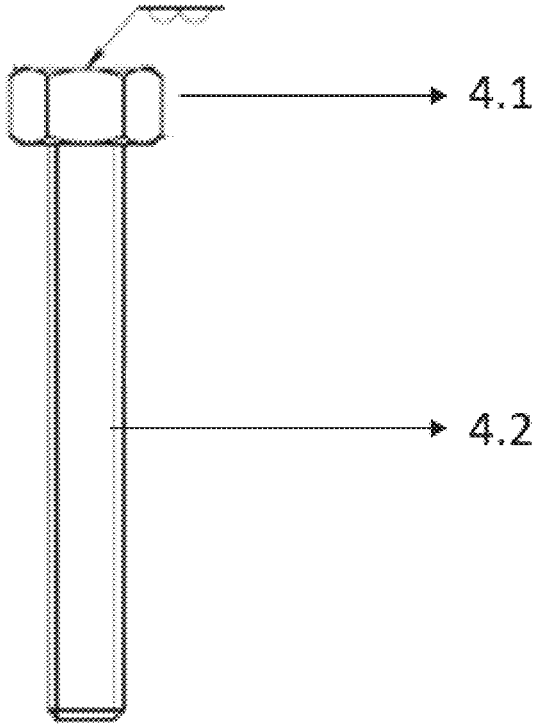
FIG. 6 shows the front view of part 04, referring to the gasket compression adjustment screws 4, according to a preferred embodiment of the present invention.

FIG. 6 shows the gasket compression adjustment screws 4, which comprise a hexagonal nut 4.1 on the head (A194 Gr. 2H) with a ⅝ diameter inch and a screw body 4.2 which is made of a threaded bar with a length of at least 140 mm and a ⅝ diameter inch, preferably manufactured in A 193 Gr. B7 steel.

It can be said that the gasket compression adjustment screws 4 are also fundamental for the functionality of the device of the present invention, since it is the gasket compression adjustment screws 4 that transmit the necessary tightening to the gasket compression ring 2.

Figure 2:
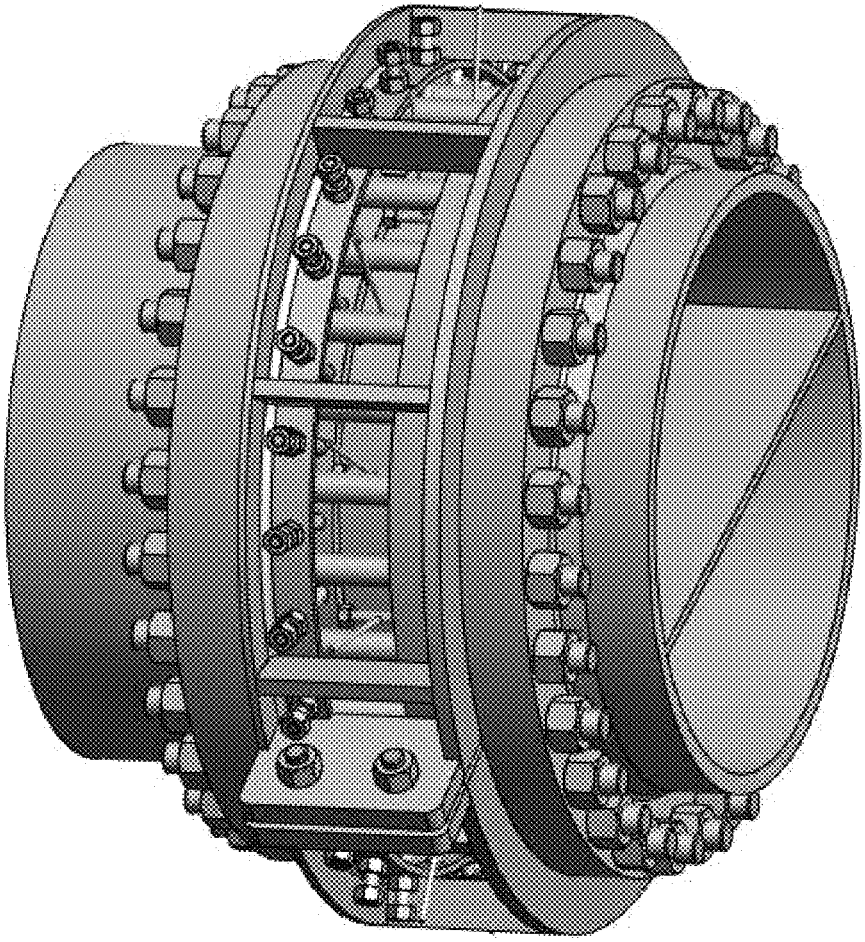
FIG. 2 represents a perspective view of the device to repair leakages in high pressure shell-and-tube heat exchangers, according to a preferred embodiment of the present invention.

FIG. 2 shows a perspective view of the device in order to better understand how the parts fit together. Firstly, the assembly of said device is done by installing a gasket in the gap, followed by the positioning of the gasket compression ring 2 over the gasket.

With the gasket compression ring 2 positioned on the gasket, the adjustment screw holder 1 is fixed on the exchanger flange, then the gasket compression adjustment screw is installed 4 in order to symmetrically adjust the gasket compression ring 2 over the gasket without tightening.

Next, the stabilizing support 3 is positioned to maintain the stability of the gasket compression ring 2, and the final tightening of the gasket compression adjustment screw 4 is carried out to eliminate leakage.

In the developed device, which can be applied in a real case (and not only in tests), and which is still installed and subjected to operating pressure and temperature, the supported pressure can be at least 56 kgf/cm$^2$ and the operating pressure is at least 48.1 kgf/cm$^2$. For the case of a supported temperature, it can be estimated at least 400° C. and operating inlet temperature of at least 339.1° C.

Those skilled in the art will value the knowledge presented herein and will be able to reproduce the invention in the presented embodiments and in other variants, covered in the scope of the appended claims.

The invention claimed is:

1. A device to repair leakages in high pressure shell-and-tube heat exchangers, the device comprising:

at least one adjustment screw holder with two symmetrical parts in the shape of a semicircle, wherein each symmetrical part comprises two joining elements at their respective ends;

at least one gasket compression ring comprising a set of smooth plates with a plurality of blind holes, wherein each blind hole is specially adapted to receive an end of a gasket compression adjustment screw;

at least one stabilizing support, having a "T" shape and comprising a cylindrical bar, a threaded bar, and hexagonal nuts; and at least one gasket compression adjustment screw, comprising a hexagonal nut and a screw body corresponding to a threaded bar.

2. The device of claim 1, wherein the two symmetrical parts have a radius of 860 mm and a thickness of ¾ inch.

3. The device of claim 1, wherein the two symmetrical parts are comprised of ASTM A283 Gr. W steel.

4. The device of claim 1, wherein each connection element comprises two hollow holes each having a diameter of approximately 28 mm.

5. The device of claim 1, wherein the adjustment screw holder further comprises an angle bracket configured to receive the gasket compression adjustment screws.

6. The device of claim 1, wherein the adjustment screw holder further comprises a plurality of reinforcing bars equally spaced in a longitudinal direction.

7. The device of claim 1, wherein the gasket compression adjustment screws are secured by hexagonal nuts.

8. The device of claim 1, wherein the gasket compression ring comprises a radius of at least 662 mm.

9. The device of claim 1, wherein the gasket compression ring prevents leakage from the gasket.

10. The device of claim 1, wherein the cylindrical bar comprises a length of at least 150 mm and a diameter of ¼ inches, and is comprised of carbon steel.

11. The device of claim 1, wherein the threaded bar comprises a length of at least 85 mm and a diameter of at least ½ inches, and is comprised of A193 Gr.B7 steel.

12. The device of claim 1, wherein the hexagonal nuts have a diameter of ½ inches and are comprised of A194 Gr. 2H steel.

13. The device of claim 1, wherein the stabilizing support stabilizes the gasket compression ring.

14. The device of claim 1, wherein the hexagonal nut has a diameter of ⅝ inches.

15. The device of claim 1, wherein the threaded bar comprises a length of at least 140 mm and a diameter of ⅝ inches, and is comprised of A-193 Gr. B7 steel.

16. The device of claim 1, wherein the gasket compression adjustment screws impart torque to the gasket compression ring.

17. A method of assembling a device to repair leakages in high pressure shell-and-tube heat exchangers, the method comprising:

installing a gasket in a heat exchanger gap;

positioning a gasket compression ring on the gasket, wherein the gasket compression ring comprises a set of smooth plates with a plurality of blind holes, wherein each blind hole is specially adapted to receive an end of a gasket compression adjustment screw;

subsequently fixing a screws adjustment holder, wherein the screws adjustment holder comprises two symmetrical parts in the shape of a semicircle, wherein each symmetrical part comprises two joining elements at their respective ends; and installing the gasket adjustment compression screw to symmetrically adjust the gasket compression ring, the gasket adjustment compression screw comprising a hexagonal nut and a screw body corresponding to a threaded bar.

* * * * *